United States Patent [19]

Marletta

[11] 3,962,948

[45] June 15, 1976

[54] ZITHER-CHORD

[76] Inventor: Michael Marletta, 278 E. 203rd St., Bronx, N.Y. 10458

[22] Filed: June 9, 1975

[21] Appl. No.: 585,071

[52] U.S. Cl. ..... 84/294

[51] Int. Cl.[2] ..... G10D 3/02

[58] Field of Search ..... 84/170, 173, 263, 267, 84/268, 269, 270, 274, 284–285, 290, 294, 307

[56] References Cited

UNITED STATES PATENTS 636,692 11/1899 Patch ..... 84/170 X

*Primary Examiner*—Lawrence R. Franklin

*Attorney, Agent, or Firm*—Richard L. Miller

[57] ABSTRACT

A device placed upon a guitar in order to change a sound produced by the guitar into a sound of a zither or balilaika; the device consisting of a bridge mounted upon the guitar top panel or table and which straddles the six strings, and six hammers depending downward freely from the bridge to a position alongside each string so that the vibrating string will bounce the hammer resulting in a tinkling sound.

3 Claims, 3 Drawing Figures

10
11
12
13
14
15
16
17
18
19
20
21
22
23
24
25
26
27
28

ZITHER-CHORD

This invention relates generally to stringed musical instruments.

A principal object of the present invention is to provide a means whereby the sound that is produced by a guitar can be changed so that it will tingle and thus sound like a zither or a balilaika.

Another object is to provide a zither-chord in which the tingle sound is produced by a device mounted upon the guitar table, and which can be readily removed therefrom whenever the produced sound is again intended to be that of a guitar.

Still another object is to provide a zither-chord in which the principal of the invention may possibly be applied to other stringed instruments, particularly such that are plucked.

Other objects are to provide a zither-chord which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figures 1, 2, 3:
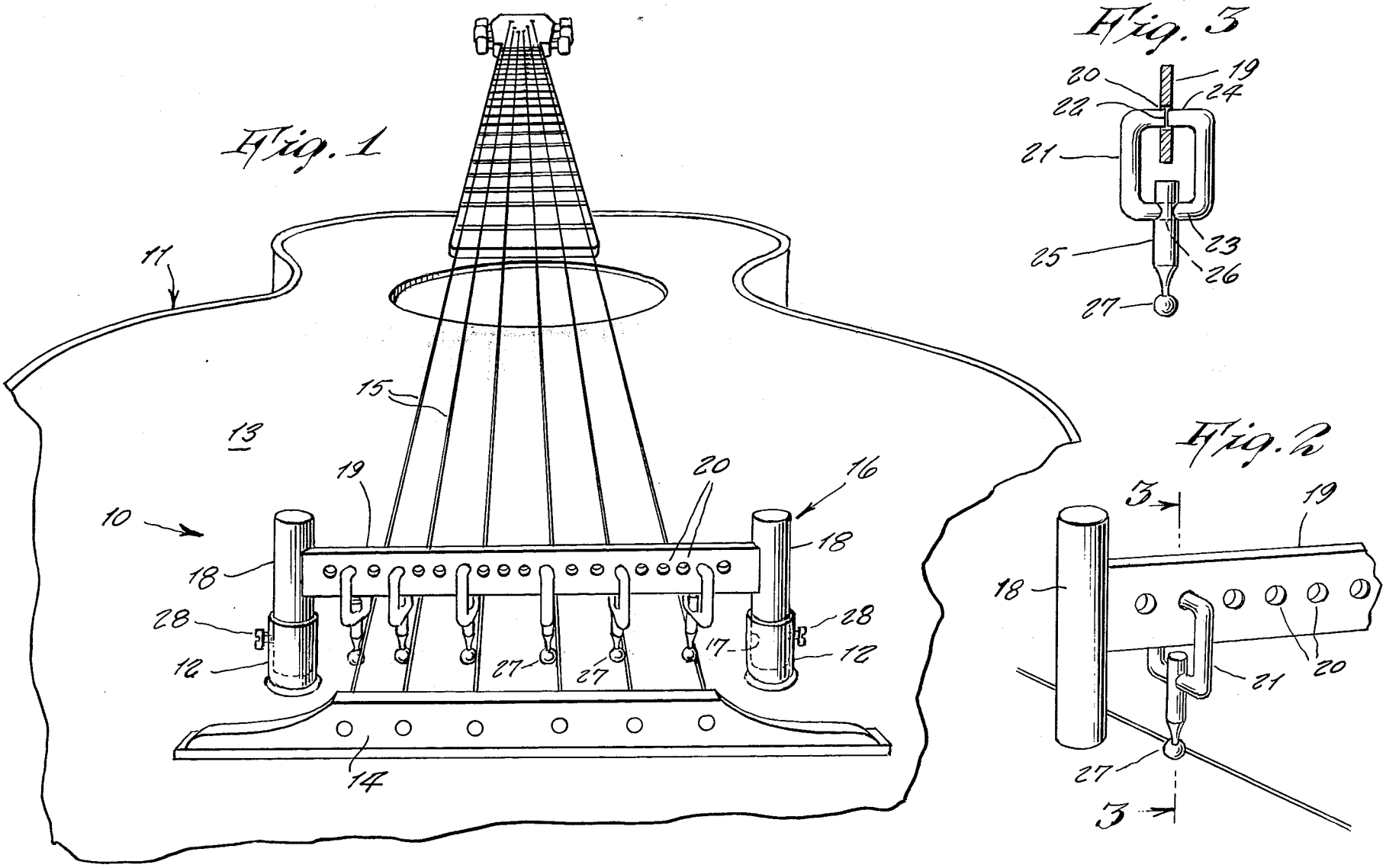
FIG. 1 is a perspective view of the invention mounted upon a guitar.
FIG. 2 is an enlarged detail view thereof.
FIG. 3 is a cross sectional view on line 3—3 of FIG. 2.

Referring now to the drawing in detail, the reference numeral 10 represents a zither-chord according to the present invention wherein the same is mounted upon a guitar 11.

The device 10 includes a pair of socket members 12 which are attachable by suitable means upon a table or front panel 13 of the guitar and are located near each end of a tail piece 14 to which one ends of the guitar strings 15 are anchored.

A removable bridge 16 for bridging across the strings 15, is adjustably supported in the sockets 17 of the socket members, and the elevation of the bridge may be raised or lowered.

The bridge consists of parallel posts 18, slidably received in the sockets, and a bar 19 extending between the posts; the posts and bar being rigidly made together. There is a row of openings 20 along the bar 19; the openings being adaptable for selectively supporting a plurality of open rings 21 each of which has a slot 22 in order that the rings may be snapped into the openings 20. The rings are of rectangular shape so to have a straight side 23 located opposite the side 24 that has the slot at its center. A hammer 25 comprises an elongated pin having a transverse opening 26 for receiving the side 23 of the ring, the opening 26 being larger than a diameter of the ring side 23 so that the hammer depends freely downwardly therefrom. The ring, it will be noted is thus made of a round stock material bent into the shape shown. The openings 20 are likewise larger in diameter than the stock diameter of the ring so that the ring depends frictionally free therefrom. All the parts are made of a hard metal such as a suitable steel.

Each of the downwardly depending hammers has a spherically shaped, enlarged hammerhead 27 at its lower end which is positioned along a side of one of the strings, by means of raising or lowered the posts within the sockets and securing the posts at the desired elevation by means of a set screw 28.

In this position, when the strings are plucked, during a playing of the instrument, the vibrating strings strike the hammerheads thus creating a tinkling sound so the guitar sounds like a zither or balilaika.

While certain novel features of this invention have been shown and described and are pointed out in the annexed claims, it will be understood that various omisions, substitutions and changes in the forms and details of the device illustrated and in its operation can be made by those skilled in the art without departing from the spirit of the invention.

I claim:

1. In a zither-chord, the combination of a stringed musical instrument such as a guitar, a pair of socket members affixed upon an upper side of a table of said instrument, each socket member having a socket, and a removable bridge mountable in said sockets said bridge straddling a set of strings of said instrument and means depending from said bridge for being struck by said strings while vibrating when being plucked during playing.

2. The combination as set forth in claim 1 wherein said bridge comprises a pair of posts slidable in said sockets, a bar secured at opposite ends in said posts, said bridge being affixed at selected elevation in said posts by set screws threaded in a side of said socket member, said bar having a row of openings supporting said depending means.

3. The combination as set forth in claim 2 wherein said depending means comprises a plurality of open slotted rings depending freely from said bar openings, and a hammer depending freely from each said ring, each said hammer comprising a pin having a transverse opening receiving said ring, and a lower downward depending end of said pin being spherically shaped for being struck by said strings.

* * * * *